US008418981B1

(12) United States Patent
Lowe et al.

(10) Patent No.: US 8,418,981 B1
(45) Date of Patent: Apr. 16, 2013

(54) HUGGER FAN TWIST-LOCK MECHANISM AND METHOD

(75) Inventors: Tien S. Lowe, Cooper City, FL (US); Shih-Tza Wu, Lighthouse Point, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 140 days.

(21) Appl. No.: 12/966,688

(22) Filed: Dec. 13, 2010

Related U.S. Application Data

(60) Provisional application No. 61/286,168, filed on Dec. 14, 2009.

(51) Int. Cl.
*B42F 13/00* (2006.01)

(52) U.S. Cl.
USPC ..... 248/342; 248/343; 248/222.52

(58) Field of Classification Search ..... 248/342, 248/343, 344, 220.21, 220.22, 221.11, 222.1, 248/222.51, 225.11; 416/244 R, 244 A; 403/348, 403/350, 353
See application file for complete search history.

(56) References Cited

U.S. PATENT DOCUMENTS

| | | | | |
|---|---|---|---|---|
| 4,754,383 | A | 6/1988 | Klaus | |
| 5,947,436 | A | 9/1999 | Bucher | |
| 5,988,580 | A | 11/1999 | Bucher | |
| 6,171,061 | B1 * | 1/2001 | Hsu | 416/244 R |
| 6,171,062 | B1 | 1/2001 | Bucher | |
| 6,200,099 | B1 | 3/2001 | Liao | |
| 6,517,316 | B1 | 2/2003 | Gajewski | |
| 6,653,558 | B1 | 11/2003 | Bucher | |
| 6,872,054 | B2 * | 3/2005 | Pearce | 416/244 R |
| 7,300,248 | B2 | 11/2007 | Wang | |
| 7,540,461 | B2 | 6/2009 | Liang | |
| 7,786,379 | B1 | 8/2010 | Kwong | |
| 2003/0189151 | A1 | 10/2003 | Hsing | |
| 2003/0210983 | A1 | 11/2003 | Yung | |
| 2010/0329885 | A1 * | 12/2010 | Criner et al. | 416/244 R |

* cited by examiner

*Primary Examiner* — Alfred J Wujciak

(74) *Attorney, Agent, or Firm* — Brian S. Steinberger; Law Offices of Brian S. Steinberger, P.A.

(57) ABSTRACT

Mechanisms, devices, apparatus, systems and methods of installing ceiling fan motor housings to ceiling mounted plates without using loose fasteners such as screws, and the like. A plate having a plurality of slots about the perimeter can be pre-mounted to a ceiling. A motor housing having clips on interior perimeter edges of the base can be positioned so that the clips are inserted into the slots. Next, the motor housing can be twisted clockwise until the clips lock to the slots allowing the ceiling fan motor to be hung without any loose fasteners. The twist-lock eliminates unsightly fasteners, such as screws underneath the housing, quickens installation time, and is easier and safer than traditional ceiling fan installation techniques.

19 Claims, 4 Drawing Sheets

HUGGER FAN TWIST-LOCK MECHANISM AND METHOD

This invention claims the benefit of priority to U.S. Provisional Application 61/286,168 filed Dec. 14, 2010.

FIELD OF INVENTION

This invention relates to mounts for ceiling fixtures, in particular to mechanisms, devices, apparatus and methods for allowing a motor housing on a ceiling fan to be twist mounted to a pre-attached ceiling plate without using visible fasteners.

BACKGROUND AND PRIOR ART

The mounting of ceiling fans are often difficult since installers will need to have their hands raised above their head while supporting heavy components such as the ceiling fan motor, motor housing, and the like. Installations often will take place with the installer being perched on a ladder which also adds to the requirement of the installer having to maintain their balance while doing the installation. Currently, the decorative shell housings covering the ceiling fan motor must be fastened often by screws, and the like, into a ceiling mounted plate. The combination of having to hold a screw driver over one's head with loose screw fasteners while supporting a motor housing with or without a heavy motor is tedious and time consuming. Furthermore, it is potentially dangerous if the housing with or without the motor happens to fall.

In addition, the screw type fasteners will tend to fall out during installation which causes the installer to have to repeat the attempts to mount the fan. The falling screws will often become lost so that additional screw type fasteners must be used, which adds additional time and material expense to the installation of the fan.

Additionally, the appearance of visible screw heads from the attached motor housing beneath the fan is not a desirable since the appearance of these fasteners takes away from the aesthetic effect after the ceiling fan is installed.

Thus, the need exists for solutions to the above problems with the prior art.

SUMMARY OF THE INVENTION

A primary objective of the present invention is to provide mechanisms, devices, apparatus, systems and methods of mounting a ceiling fan motor housing to a ceiling attached plate that eliminates having to use and lose fasteners such as screws, and the like.

A secondary objective of the present invention is to provide mechanisms, devices, apparatus, systems and methods of mounting a ceiling fan motor housing to a ceiling attached plate that results in an improved aesthetic appearance since fasteners are no longer visible from beneath the fan.

A third objective of the present invention is to provide mechanisms, devices, apparatus, systems and methods of mounting a ceiling fan motor housing to a ceiling attached plate that substantially reduces the installation time of mounting a ceiling fan motor.

A fourth objective of the present invention is to provide mechanisms, devices, apparatus, systems and methods of mounting a ceiling fan motor housing to a ceiling attached plate that is easier, quicker and more safe to install than traditional methods of using fasteners to mount a ceiling fan motor.

A fifth objective of the present invention is to provide mechanisms, devices, apparatus, systems and methods of mounting a ceiling fan motor housing to a ceiling attached plate while only having to twist and lock the ceiling fan motor onto the ceiling attached plate.

A hanging system for mounting ceiling fans to ceiling mounted plates, can include a plate that is mounted to a ceiling adjacent to a power supply, a ceiling fan motor housing cover, and a plurality of clips and slots for mounting the motor housing cover to the mounted ceiling plate by twist locking clips into respective slots, without using loose screw fasteners to attach the motor housing to the plate, and without using visible fasteners that attach the motor housing cover to the ceiling fan motor.

The system can include the plurality of slots about a perimeter of the plate, and the motor housing includes the clips about a perimeter of the housing.

The system can include the plurality of slots about a perimeter of the motor housing, and the plate includes the clips about a perimeter of the plate.

The clips can be C-shapes, with exposed leg portions of at least one bend.

The plate can have a substantially disc shape. There can be four clips that twist lock about four longitudinal slots. The clips can be pre-attached about an inner surface of an open base edge on a wide open end of housing cover.

A method of mounting ceiling fan motors to ceiling mounted plates without using loose fasteners, can include the steps of providing a mounting plate, providing a ceiling fan motor housing, providing a plurality of clips, and a plurality of slots, attaching the mounting plate to a ceiling and twisting the clips into the slots so that the ceiling fan motor housing is attached to the ceiling mounted plate, without using additional loose fasteners, and without having visible fasteners that attach the motor housing to the ceiling fan motor.

The twisting can be clockwise twisting of the motor housing relative to the mounted plate. The twisting can be counterclockwise twisting the motor housing relative to the mounted plate.

The method can include the steps of providing the slots about the perimeter of the plate, providing the clips about the perimeter of the motor housing, inserting the clips into the slots, and twisting the clips until the clips are locked into the slots.

The method can include the steps of providing the slots about the perimeter of the motor housing, providing the clips about the perimeter of the plate, inserting the clips into the slots, and twisting the clips until the clips are locked into the slots.

The method can include the step of attaching a motor to the plate before the motor housing is attached to the plate.

The method can include the step of pre-attaching the clips about an inner surface of an open base edge on a wide open end of the housing cover.

The clips can be C-shapes with an exposed leg portion having at least one bend. Four clips and four longitudinal slots can be used. Alternatively, less or more clips and slots can be used as needed.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components will now be described.

Figure 1:
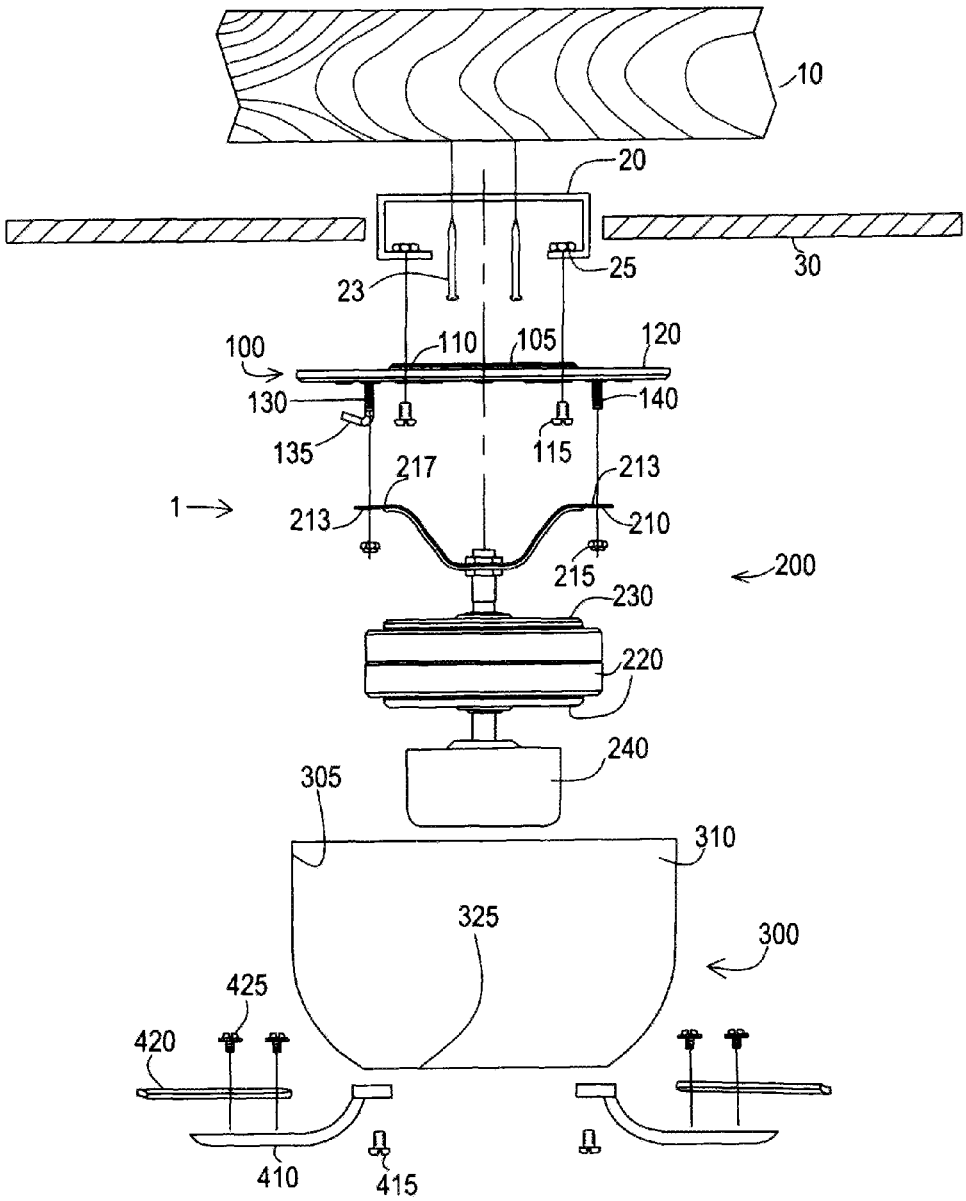
FIG. 1 is an exploded view of the novel twist lock mechanism with ceiling fan components ready for installation.
Figure 2:
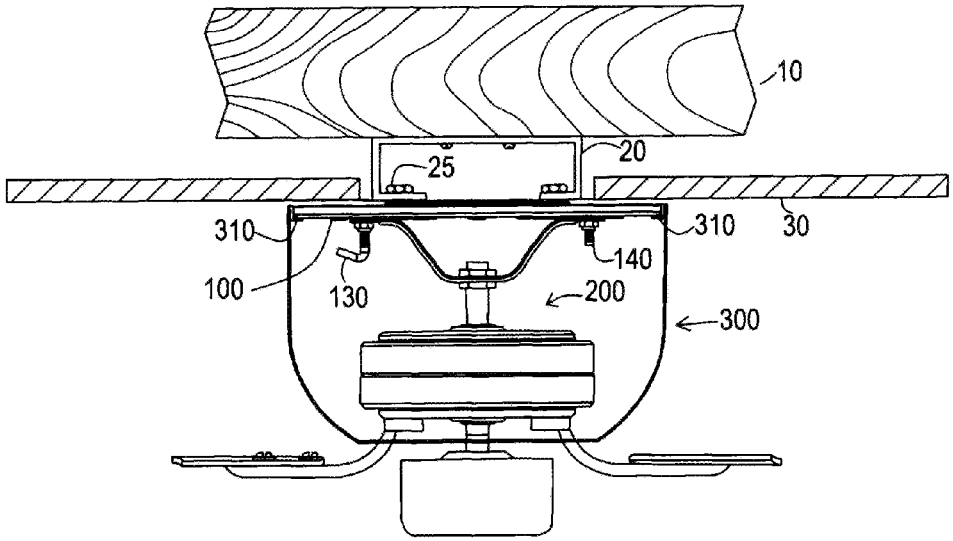
FIG. 2 shows the twist lock components and the ceiling fan of FIG. 1 installed on a ceiling.
Figure 3:
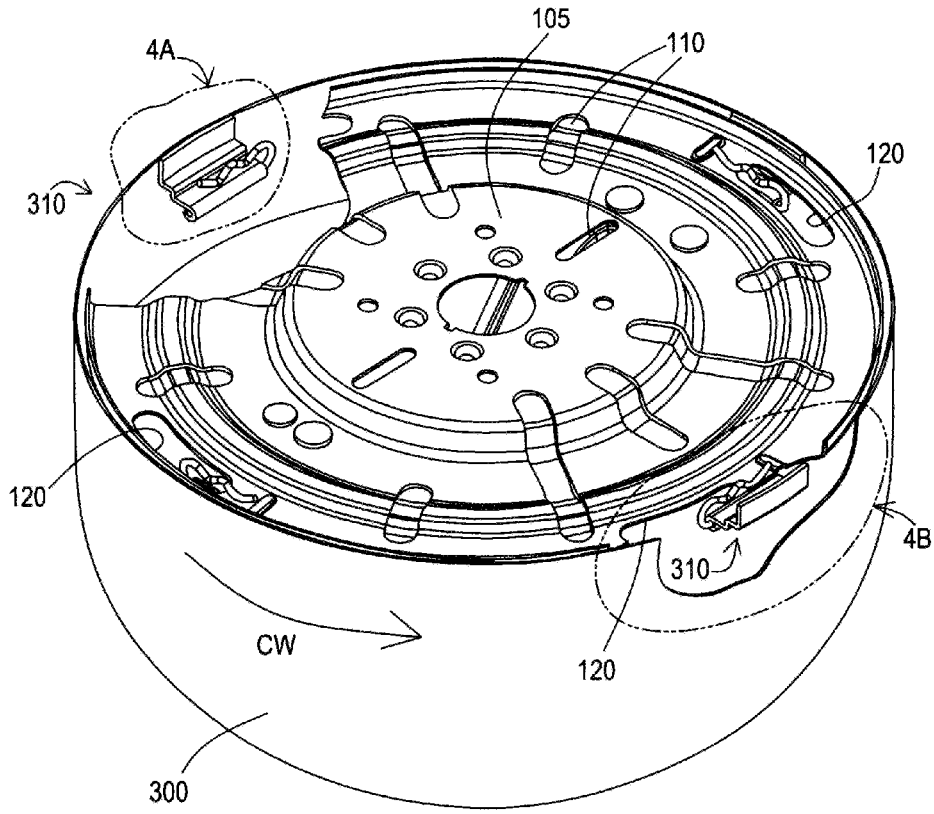
FIG. 3 is an enlarged upper perspective view of the motor housing twist locked to the ceiling mounting plate with partial cut-away views of two of the twist hook mechanisms.

1. twist lock mechanism
10. Ceiling joist
20. Ceiling mounted outlet box
23. Joist mounting fasteners (screws)
25. mounting (female fasteners) nuts
30. Ceiling drywall
100. novel mounting plate
105. raised middle portion
110. mount holes to attach to outlet box
115. screw fasteners attach plate to outlet box
120. longitudinal oval slots spaced about perimeter of plate
130. downwardly extending hook on male coupler fastener
135. hook end
140. male coupler fastener
200. fan components
210. hang bracket
213. mounting holes for hang bracket
215. female fasteners (nuts)
217. hanger opening in hang bracket
220. rotor
230. motor
240. light attached beneath motor
300. motor cover housing
305. inner perimeter of the open base edge of cover housing
310. clips pre-attached along inner edge of housing perimeter
312. clip bases
313. step portion
314. lower ledge
315. mounting end
316. C-shaped clip
317. lower leg
318. pre-bent upper leg
325. opening in bottom of cover housing
410. blade arms
415. mounting fasteners to attach blade arms to rotor
420. ceiling fan blades
425. fasteners (screws) to attach inner blade ends to blade arms FIG. 1 is an exploded view of the novel twist lock mechanism 1 with ceiling fan components 200 ready for installation. FIG. 2 shows the twist lock components of the clips 310 on the ceiling motor housing 300 attached to the novel mounting plate 100 with the ceiling fan components 200, 300 of FIG. 1 installed on a ceiling 30. FIG. 3 is an enlarged upper perspective view of the motor housing 300 twist locked by clips 310 to the ceiling mounting plate 100 with partial cut-away views of two of the twist hook mechanisms 312, 313, 314, 316, 317, 318.

Referring to FIGS. 1-3, the novel invention can be attached to a conventional power outlet box 20 that has been mounted to a joist 10 behind ceiling type drywall 30 by conventional fasteners 23, such as screws, and the like. The outlet box 20 is usually pre-wired with loose wires (not shown) that can be used to power a later installed ceiling fan, and the like. The outlet box 20 can have mounting fasteners 25, such as nuts, and the like, on a lower surface of the box 20.

The novel mounting plate 100 used in the invention can have a disc configuration with raised middle portion 105. The novel mounting plate 100 can next be securely attached to the outlet box 20 in the ceiling 30 by using conventional fasteners 115, such as screws. which can pass through differently located mount holes 110 in the mounting plate 100. The differently located mount holes 110 can be selectively used depending upon the location of the female fastener locations 25 in the ceiling outlet box 20.

The novel plate 100 can also have a plurality of longitudinal oval slots 120 equally spaced about a perimeter of the plate 100. In a preferred embodiment there can be four longitudinal oval slots 120 equally spaced. However, more or less is possible as needed and/or desired.

Protruding beneath of the mounting plate 100 can be a male coupler fastener 130 with threaded sides, and a lower hook end 135. Additionally, protruding beneath an opposite side of the mounting plate 100 can be another male coupler fasteners 140 also with threaded sides.

A fan motor 230 can be provided with rotating rotor 220, and lower extending light 240, and a hanging bracket 210. The hanging bracket 210 can have a hanger opening 217 therethrough. This hanging opening 217 allows the hanging bracket 210 to be next lifted and hooked onto the lower extending hook end 135 on the male fastener 130 protruding underneath the plate 100. Although not shown, this loose hook hanging of the motor 230 will allow the installer to attach the exposed wire ends (not shown) from the motor 230 to wires (not shown) in the ceiling outlet box 20. After the wiring has been completed, the hanging bracket 210 on the motor can be attached by passing mounting holes 213 in the bracket 210 over the downwardly extending male fasteners 130, 140 that were pre-attached to the plate 100. After pushing up the hanging bracket 210, fasteners 215, such as female nuts 215, can be tightened onto the male fasteners 130, 140 so that the hanging bracket 210 is now directly attached to the plate 100.

Figure 4A:
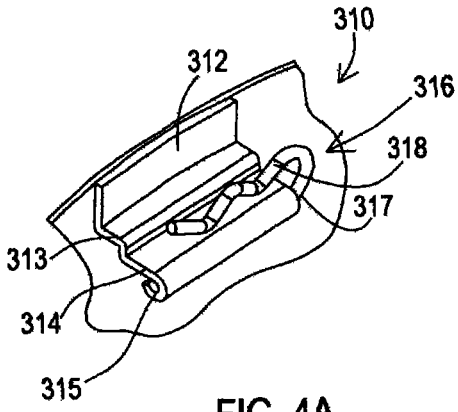
FIG. 4A is an enlarged view of one of the twist lock mechanisms of FIG. 3.
Figure 4B:
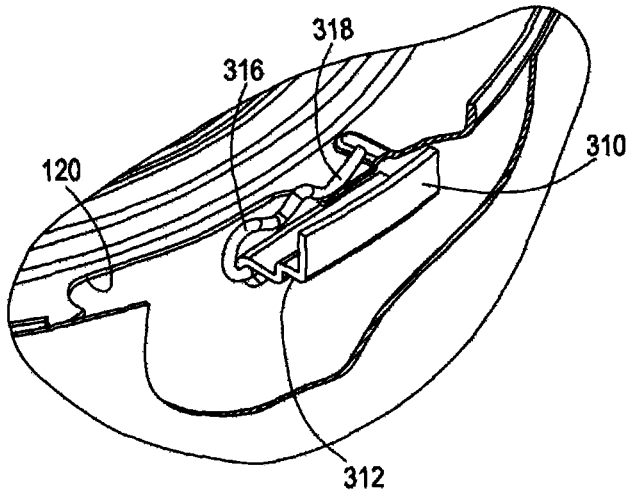
FIG. 4B is an enlarged view of another one of the twist lock mechanisms of FIG. 3.

FIG. 3 is an enlarged upper perspective view of the motor housing 300 twist locked to the ceiling mounting plate 100 with partial cut-away views of two of the twist hook mechanisms 310, 312, 315. FIG. 4A is an enlarged view of one of the twist lock mechanisms 310, 312, 315 of FIG. 3.

Referring to FIGS. 1-4, the motor cover housing 300 can have a plurality of pre-attached clips 310 that are attached along an inner perimeter of the open base edge 305 of the wide open end of the housing shell 300. In a preferred embodiment four clips 310 equally spaced apart from one another can be used. Less or more clips 310 can be used as long as the number of clips 310 matches the number of longitudinal slots 120 in the novel mounting plate 100. Each of the clips 310 can have a base 312 that is pre-attached about the open base edge 305 of the wide open end of the housing shell 300. The clips have the base 312 adjacent to a step portion 313, and lower ledge 314. A mounting end 315 on the lower ledge 314 attaches the lower leg 317 of a C-shaped clip 316, that has an pre-bent upper leg 318. The upper leg 318 can have one or more angle bends for to enhance attachment capability of the clips 310.

After the motor hanging bracket 210 is attached to the mounting plate 100, the installer can orient the housing cover 300 over the motor 230 and plate 100 so that the bendable pre-bent clip portions 318 of the C-clips 316 are all inserted into each of the longitudinal slots 120 in the plate 100. Here, the light 240 can pass through and extend beneath the lower opening 325 of the housing cover 300. The step 313 or lower ledge 314 can be positioned to abut against a lower surface perimeter of the plate 100. Next, the installer can twist the cover housing 300 in a clockwise direction relative to the plate 100 so that the exposed ends of the upper legs 318 of the clips 310 hook onto edge ends of the longitudinal slots 120. The clockwise rotation can continue until the clips 310 can no longer be rotated and have become locked onto the plate 100.

Next, the installer can attached the inner ends of the blade arms 410 to the rotor 220 by fasteners 415 such as screws, bolts, and the like, that fasten into mateable female slots (not shown) underneath the rotor 220. Next, the installer can attach the blades 420 to the outer ends of the blade arms 410 by top mounted fasteners 425, such as screws.

Although the preferred embodiment shows the longitudinal slots 120 on the plate 100, the invention can be used with the longitudinal slots 120 on the motor housing and the clips 310 on the plate 100. Still furthermore, the invention can be practiced with longitudinal slot(s) 120 and clip(s) 310 on both the plate 100, and slot(s) 120 and clip(s) 310 on the motor housing 300.

Although the preferred embodiment shows the twist locking being installed by rotating the housing 300 clockwise, the invention can be practiced with a twist lock being rotated in a counter-clockwise direction.

Although the description references male and female fasteners, the locations and types of fasteners can be varied as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A system for mounting ceiling fans to ceiling mounted plates, comprising:

a generally cylindrical plate that is mounted to a ceiling adjacent to a power supply, the generally cylindrical plate having an upper surface and a lower surface and an outer perimeter edge;

a first plurality of mounting members on the lower surface of the cylindrical plate adjacent to the outer perimeter edge, the first plurality of mounting members being selected from a plurality of C-shaped clips and elongated slots;

a ceiling fan motor housing cover having a generally cylindrical perimeter ring shaped base about an enlarged opening, the ring shaped base having contiguous solid exterior surface with no external openings therethrough, the ring shaped base having an plurality of inner protruding horizontal ledges that are generally perpendicular to the ring shaped base; and a second plurality of mounting members on the inner protruding ledges of the perimeter base of the housing cover for connecting to the C-shaped clips through the slots of the first plurality mounting member, wherein the plurality of the clips and the slots are for mounting the motor housing cover to the mounted ceiling plate by twist locking respective clips into respective slots, without using loose screw fasteners to attach the motor housing cover to the plate, and without using visible fasteners that attach the motor housing cover to the plate.

2. The system of claim 1, wherein the plate includes the plurality of the elongated slots passing through the upper surface and through the lower surface of the plate, and the motor housing cover includes legs on the plurality of the C-shaped clips facing upward from the inner protruding horizontal ledge of the ring shaped base of the motor housing cover.

3. The system of claim 1, wherein the inner protruding horizontal ledge of the ring shaped base of the motor housing cover includes the plurality of elongated slots, and the lower surface of the plate includes legs on the plurality of the C-shaped clips extending downward from the plate.

4. The system of claim 1, wherein the C-shaped clips each have a first leg connected by a bend at one end to a second leg, wherein the first leg and the second leg have a wire shaped cross-sectional shape.

5. The system of claim 1, wherein the C-shaped clips each have a first leg connected by a first bend at one end to an exposed second leg, the exposed second leg having an extra angle bend for enhancing attachment between the C-shaped clips and the elongated slots.

6. The system of claim 5, wherein the C-shaped clips include a second extra angle bend between the first bend and the first extra angle bend for enhancing attachment between the clips and the elongated slots.

7. The system of claim 1, wherein the clips include four clips and the longitudinal slots include four longitudinal slots.

8. The system of claim 1, wherein each of the elongated slots are generally oval shaped with closed inner sides forming generally elongated oval shapes.

9. A method of mounting ceiling fan motors to ceiling mounted plates without using loose fasteners, comprising the steps of:

providing a generally cylindrical mounting plate, the generally cylindrical plate having an upper surface and a lower surface and an outer perimeter edge;

providing a ceiling fan motor housing cover having a generally cylindrical perimeter ring shaped base about an enlarged opening, the ring shaped base having contiguous solid exterior surface with no external openings therethrough, the ring shaped base having an inner protruding horizontal ledge that is generally perpendicular to the ring shaped base;

providing a plurality of C-shaped clips, and a plurality of slots on the cylindrical mounting plate, being mateable to the plurality of the C-shaped clips;

attaching the mounting plate to a ceiling; and twisting the C-shaped clips into the slots so that the ceiling fan motor housing cover is attached to the ceiling mounted plate, without using additional loose fasteners, and without having visible fasteners that attach the motor housing cover to the plate.

10. The method of claim 9, wherein the twisting includes the step of:

clockwise twisting the motor housing relative to the mounted plate.

11. The method of claim 9, wherein the twisting includes the step of:

counter-clockwise twisting the motor housing relative to the mounted plate.

12. The method of claim 9, further comprising the steps of:

providing the slots about the perimeter of the plate passing through both the upper surface and the lower surface of the plate;

providing the C-shaped clips with legs having exposed ends facing upward from the inner protruding horizontal ledge of the ring shaped base of the motor housing cover inserting the exposed ends of the legs of the C-shaped clips into the slots; and twisting the clips until the clips are locked into the slots.

13. The method of claim 9, further comprising the steps of:

providing the slots on the inner protruding horizontal ledge of the motor housing cover;

providing the C-shaped clips with legs having exposed ends facing downward from the lower surface of the plate;

inserting the exposed ends of the C-shaped clips into the slots; and twisting the clips until the C-shaped clips are locked into the slots.

14. The method of claim 9, further comprising the step of:

attaching a motor to the plate before the motor housing cover is attached to the plate.

15. The method of claim 9, further providing the step of:

providing each of the C-shaped clips in C-shapes with a first leg connected by a bend at one end to a second leg, wherein the first leg and the second leg have a wire shaped cross-sectional shape.

16. The method of claim 15, wherein the C-shaped clips include:

a first leg connected by a first bend at one end to an exposed second leg, the exposed second leg having an extra angle bend for enhancing attachment between the C-shaped clips and the elongated slots.

17. The method of claim 16, further comprising the steps of:

providing four clips; and providing four longitudinal slots.

18. The method of claim 16, wherein the C-shaped clips include a second extra angle bend between the first bend and the first extra angle bend for enhancing attachment between the clips and the elongated slots.

19. The method of claim 9, wherein each of the elongated slots are generally oval shaped with closed inner sides forming generally elongated oval shapes.

* * * * *